United States Patent [19]

Baggio et al.

[11] Patent Number: 4,884,760

[45] Date of Patent: Dec. 5, 1989

[54] LOCKING AND ADJUSTMENT DEVICE PARTICULARLY FOR SKI BOOTS

[75] Inventors: Giorgio Baggio, San Martino di Lupari; Mirko Baratto, Bigolino di Valdobbiadene, both of Italy

[73] Assignee: Nordica S.P.A., Montebelluna TV, Italy

[21] Appl. No.: 138,902

[22] Filed: Dec. 28, 1987

[30] Foreign Application Priority Data

May 15, 1987 [IT] Italy ..... 82550 A/87

[51] Int. Cl.[4] ..... A43B 5/04; A43L 11/00; B65H 75/48

[52] U.S. Cl. ..... 242/54 R; 24/68 SK; 242/107.4 R; 36/50

[58] Field of Search ..... 242/107.4, 54 R, 125.1; 36/50; 24/68 SK, 69 SK

[56] References Cited

U.S. PATENT DOCUMENTS 2,488,858 11/1949 Franz ..... 242/107.4
3,632,060 1/1972 Balder ..... 242/107.4 R
4,061,291 12/1977 Cunningham ..... 242/107.4 X
4,680,878 6/1987 Pozzobon et al. ..... 36/50 X
4,748,726 5/1988 Schoch ..... 36/50 X

*Primary Examiner*—Stuart S. Levy
*Assistant Examiner*—Steven M. duBois
*Attorney, Agent, or Firm*—Guido Modiano; Albert Josif

[57] ABSTRACT

The device has a box-like body rotatably supporting a spool for winding one or more cables, a pivot rigidly connected to the spool, and a knob engaging the pivot in screw thread engagement relationship for actuating the spool. The pivot is connected to a toothed ring which interacts with a ratchet mechanism for preventing cable from being unwound from the spool upon a rotational movement being imparted thereto by turning the knob in one direction, and which permits cable to be unwound from the spool upon turning the knob in another direction. A pawl element has one portion which slides within a helical seat defined by a flange rigidly associated with the spool, and another portion which slides within a guide formed radially on the box-like body, for limiting the stroke of the rotational movement of the spool.

15 Claims, 1 Drawing Sheet

LOCKING AND ADJUSTMENT DEVICE PARTICULARLY FOR SKI BOOTS

BACKGROUND OF THE INVENTION

The present invention relates to a locking and adjustment device particularly usable in ski boots.

Devices for locking cables are currently known having a knob for winding a cable at adapted winders and/or pulleys.

U.S. Pat. No. 4,433,456, filed by the same Assignee, discloses a device comprising a box-like body provided with a knob acting on a spool for winding at least one cable, said device having ratchet-gear means controlled by said knob and adapted to lock said spool in any position during the rotation of said knob in one direction and to unlock said spool upon the rotation of said knob in the opposite direction.

To prevent the skier, unwinding the cable, from accidentally rotating the knob such as to cause said cable to wind in the opposite direction with respect to the designed one, the device has an axially raised tooth, of an inner set of teeth provided on said spool, which interferes with a small collar provided at the base of the teeth of a small pinion associated with the knob, said interference locking the relative rotation of said pinion with respect to a set of teeth present at a flange provided on an axial body protruding from a ring rigidly associated in rotation with said small pinion associated with said knob.

This device however has the disadvantage of being relatively expensive due to the particular mechanical machinings and to the related toerances to be imposed on the components of the device to prevent the rotation of the knob beyond the point of maximum unwinding.

As a partial solution to this disadvantage, European Pat. No. 0 132 744 by the same Assignee, discloses a device having an actuation element comprising a spool for the winding of a cable rigidly associated in rotation with a knob supported, with the possibility of rotation and axial translatory motion, by a fixed body associated with the shell.

To prevent the rotation of said knob beyond the point of maximum unwinding, a stroke limit element is provided, constituted by a pin extending axially from said knob which engages by contact with a stop abutment defined on the shell constituting the boot.

This device also has disadvantages, only one turn of winding being allowed for the knob, this limitation being very restrictive for the use of the device, a single turn not being always sufficient to ensure an adequate locking of the cable.

SUMMARY OF THE INVENTION

The aim of the present invention is to eliminate the disadvantages described above in known types, by providing a device, applicable to a ski boot, for locking and adjusting a tensioning element, such as a cable, by means of a knob actuatable by the skier, which allows to prevent the accidental and/or intentional winding of said cable beyond the point of maximum unwinding.

Within the scope of the above described aim, another important object is to provide a device which associates with the preceding characteristic that of being structurally simple and reliable in use.

Not least object is to provide a device which has modest costs and which allows at the same time to achieve the optimum locking of the boot.

This aim and the objects mentioned, as well as others which will become apparent hereinafter, are achieved by a locking and adjustment device, comprising a box-like body associable with a ski boot and provided with a knob, said knob actuating with a spool for winding at least one cable, said knob being rotatably associated with the stem of a toothed ring interacting with ratchet-gear means adapted to lock and unlock said spool during the rotation of said knob in one direction and in the opposite direction, said device further comprising a flange associated with said spool and having at least one helical seat for an element slideable thereat within a guide provided on said box-like body radially to said flange.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
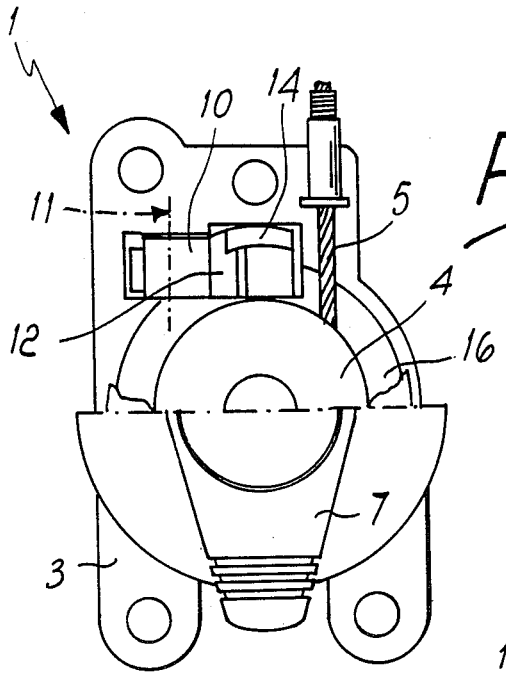
FIG. 1 is a partially cutout plan view of the device.

With reference to the above described figures, the locking and adjustment device, indicated by the numeral 1, comprises a box-like body 2, associable with the flap 3 of a ski boot, internally whereto a cavity is defined in which a spool 4 is rotatably accommodated, having an annular groove for the accommodation of a cable 5 windable thereat.

Figure 2:
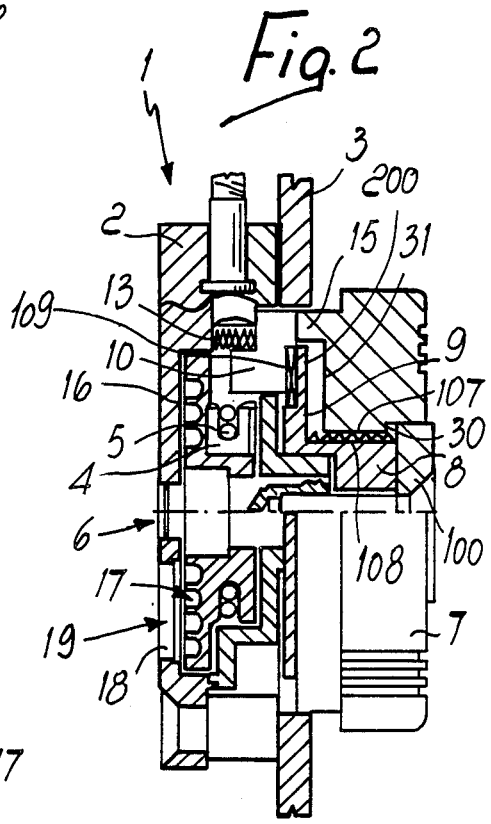
FIG. 2 is a view along the middle sectional plane longitudinal to the device.
Figure 3:
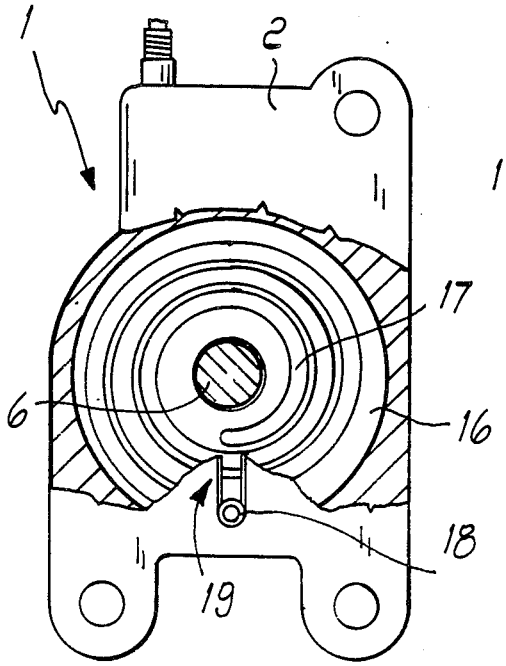
FIG. 3 is a plan view of the device in partial cross section, pointing out the flange having the helical seat.

With said spool 4 there is associated a pivot 6, rigidly associated at one end with an element 100 (see FIG. 2).

A stem 8 having an external thread formation 108 has, at an end thereof facing towards said spool 4, a toothed ring 9 with the teeth directed towards said spool, in rigid rotatory relationship with the pivot 6 and coaxial therewith.

A knob 7 positioned at the exterior of the boot flap 3 couples with the stem 8, the knob having a cylindrical through seat 107 the walls whereof are complementarily threaded with respect to the thread provided on the stem 8. As shown in FIG. 2, the knob 7 has an abutment step 30 and an abutment face 31.

Preferably said thread formation 108 is a left-handed rapid thread, and extends between the element 100 and a face 200 defined by the toothed ring 9, as shown in FIG. 2.

The teeth 109 of the toothed ring 9 interact with ratchet-gear means constituted by a ratchet 10 pivoted to the box-like body 2 and rotatable about an axis 11 arranged on a plane perpendicular to the axis of said toothed ring 9.

Said ratchet 10 has an engagement tooth 12 which couples removably with the set of teeth present on the toothed ring 9, the presence of a spring 13 and the configuration of said engagement tooth allowing the rotation of the toothed ring 9 in the direction of winding of the cable and locking the same upon a rotation in the opposite direction.

Said ratchet 10 furthermore has a shoulder 14 adapted to engage by contact with an actuation edge 15 defined on the inner face of the knob 7.

With the spool 4 there is furthermore associated, on the opposite side with respect to the knob 7, a flange 16 rigidly associated in rotation therewith. Gears may be interposed between the spool and the flange.

A seat 17 having a helical configuration is provided at the surface of said flange directed towards the side opposite to said knob.

Within said seat an element constituted by a pawl 18 is slideably accommodated at the end, protruding beyond said seat 17 and slideable at the other end within an adapted guide 19 provided on said box-like body radially to said flange.

The use of the device is therefore as follows: upon a rotation being imparted clockwise to the knob 7, the threaded through seat 107 translates along the external thread formation 108 of the stem 8, until the abutment 30 of the knob 7 abuts against the element 100, thereby rotatively coupling the knob 7 with the stem 8, and spacing the actuation edge 15 away from the shoulder 14 of the ratchet 10. Thus, the cable 5 winds within the spool 4, the ratchet 10 preventing the unwinding thereof.

As a rotation is progressively imparted to the spool 4, the pawl 18 is caused to move along the guide 19 due to the presence of the seat 17 on the flange 16.

A first winding stroke limit is thus defined, reached once the pawl 18 abuts on the end of the guide 19 placed adjacent to the pivot 6.

The configuration of the seat 17 and the length of the guide 19 are naturally such as to allow an adequate degree of locking before reaching said winding stroke limit.

If instead the skier wishes to unwind the cable he rotates the knob anticlockwise: by doing this, the threaded through seat 107 translates along the external thread formation 108 of the stem 8 until the abutment face 31 of the knob 7 abuts against the face 200 of the toothed ring 9, thereby rotatively coupling the knob 7 with the stem 8 and moving the actuation edge 15 into engagement with the shoulder 14. Thus, the actuation edge 15 pushes the shoulder 14 of the ratchet 10 causing the disengagement of the engagement tooth 12 from the set of teeth of the toothed ring 9.

The subsequent rotation of the knob allows the unwinding of the cable and consequently causes the pawl 18 to move in the guide 19 moving away from the pivot 6.

Once the pawl 18 reaches the end of the guide 19 an unwinding stroke limit is thus defined which prevents the further rotation of the knob and therefore the winding of said cable in the opposite direction with consequent damage thereof. Preferably the ends of the seat 17 are affected by the pawl 18 if the pawl is at the ends of the guide 19.

It has thus been observed that the invention achieves the intended aim and objects, a device having been provided preventing the accidental winding of the cable beyond the point of maximum unwinding.

The device achieves these characteristics with a simple and reliable structure.

The structural simplicity furthermore implies constructively very simple components with a consequent reduction of costs and greater reliability in use.

The provision of a winding stroke limit and of an unwinding stroke limit still allows an adequate degree of locking of the cable.

Naturally the invention thus conceived is susceptible to numerous modifications and variations, all within the scope of the same inventive concept.

Thus the materials, as well as the dimensions of the individual components of the device, may also be the most suitable according to the specific requirements.

We claim:

1. Locking and adjustment device particularly for ski boots comprising:

a box-like body, at least one cable, winding means rotatably accommodated in said box-like body ratchet gear means mounted on said box-like body and being moveable from a first position whereat said ratchet means interfere with said winding means to permit rotation thereof in a cable winding direction, to a second position whereat said ratchet means do not interfere with said winding means to permit rotation thereof in a cable unwinding direction, at least one actuating member rotatably connected to said winding means externally of said box-like body, means for rotatively engaging said actutating member with said winding means, at least one actuation formation rigidly associated with said actuating member, and means for converting said rotational movement of said actuating member into translatory movement of said actuation formation for moving said actuation formation into engagement with and away from said ratchet gear means for moving said ratchet gear means between said first position and said second position.

2. Locking and adjustment device according to claim 1, wherein said winding means comprise;

at least one spool rotatably accommodated in said box-like body means for at least partially accommodating said at least one cable on said spool, at least one pivot connected to said spool, at least one stem connected to said pivot, at least one engageable member rigidly associated with said stem.

3. Locking and adjustment device according to claim 2, wherein said ratchet gear means are moveable from said first position whereat said ratchet means interfere with said engageable member to permit rotation of said spool in said cable winding direction, to said second position whereat said ratchet means do not interfere with said engageable member to permit rotation of said spool in said cable unwinding direction, said actuating member being rotatably connected to said stem, and;

wherein said means for rotatively engaging said actuating member with said winding means comprise means for rotatively engaging said actuating member with said stem.

4. Locking and adjustment device according to claim 1, wherein said winding means comprise;

at least one spool rotatably accommodated in said box-like body means for at least partially accommodating said at least one cable on said spool, at least one pivot connected to said spool, at least one stem connected to said pivot, and at least one engageable member rigidly associated with said stem;

wherein said ratchet gear means are moveable from said first position whereat said ratchet means interfere with said engageable member to permit rotation of said spool in said cable winding direction, to said second position whereat said ratchet means do not interfere with said engageable member to permit rotation of said spool in said cable unwinding direction, said actuating member being rotatably connected to said stem, wherein said means for rotatively engaging said actuating member with said winding means comprise means for rotatively engaging said actuating member with said stem, and, wherein said means for converting said rotational movement of said actuating member into translatory movement of said actuation formation comprise, external threads formed on said stem, and at least one threaded through seat formed in said actuating member, said threaded through seat engaging said external threads formed on said stem.

5. Locking and adjustment device acording to claim 2, wherein said means for converting said rotational movement of said actuating member into translatory movement of said actuation formation comprise;

external threads formed on said stem, and at least one threaded through seat formed in said actuating member, said threaded through seat engaging said external threads formed on said stem, and wherein said means for rotatively engaging said actuating member with said winding means comprise;

at least one element rigidly associated with said pivot, and at least one face defined by said engageable element, said external threads being formed on said stem between said face and said element, said threaded through seat of said actuating member being rotatable on said external threads of said stem inone direction until said actuating member abuts said element, thereby rotatively engaging said actuating member with said stem in said cable winding direction, said threaded through seat of said actuating member also being rotatable on said external threads of said stem in another direction until said actuating member abuts said face, thereby rotatively engaging said actuating member with said stem in said cable unwinding direction.

6. Locking and adjustment device according to claim 2, wherein said spool hs rigidly associated therewith a flange defining a seat having a helical configuration, wherein said box-like body has formed thereon a radial guide overlying said seat, and wherein said device further comprises at least one pawl element, said pawl element being partially accommodated in said seat and partially accommodated in said radial guide for defining winding and unwinding stroke limits of said spool.

7. Locking and adjustment device particularly for ski boots comprising:

a box-like body, at least one cable, at least one spool rotatably accommodated in said box-like body means for at least partially accommodating said at least one cable on said spool, at least one pivot connected to said spool, at least one stem connected to said pivot, at least one engageable member rigidly associated with said stem, ratchet gear means mounted on said box-like body and being moveable from a first position whereat said ratchet means interfere with said engageable member to permit rotation of said spool in a cable winding direction, to a second position whereat said ratchet means do not interfere with said engageable member to permit rotation of said spool in a cable unwinding direction, at least one actuating member rotatably connected to said stem externally of said box-like body, means for rotatively engaging said actuating member with said stem, at least one actuation formation rigidly associated with said actuating member, and means for converting said rotational movement of said actuating member into translatory movement of said actuation formation for moving said actuation formation into engagement with and away from said ratchet gear means for moving said ratchet gear means between said first position and said second position.

8. Locking and adjustment device according to claim 7, wherein said means for converting said rotational movement of said actuating member into translatory movement of said actuation formation comprise:

external threads formed on said stem, and at least one threaded through seat formed in said actuating member, said threaded through seat engaging said external threads formed on said stem.

9. Locking and adjustment device according to claim 7, wherein said means for converting said rotational movement of said actuating member into translatory movement of said actuation formation comprise;

external threads formed on said stem, and at least one threaded through seat formed in said actuating member, said threaded through seat engaging said external threads formed on said stem, and wherein said means for rotatively engaging said actuating member with said stem comprise;

at least one element rigidly associated with said pivot, and at least one face defined by said engageable element, said external threads being formed on said stem between said face and said element, said threaded through seat of said actuating member being rotatable on said external threads of said stem in one direction until said actuating member abuts said element, thereby rotatively engaging said actuating member with said stem in said cable winding direction, said threaded through seat of said actuating member also being rotatable on said external threads of said stem in another direction until said actuating member abuts said face, thereby rotatively engaging said actuating member with said stem in said cable unwinding direction.

10. Locking and adjustment device according to claim 9, wherein said actuation formation engages and moves said ratchet gear means from said first position to said second position upon said actuating member being rotated on said external threads of said stem in said another direction until said actuating member abuts said face, thereby rotatively engaging said actuating member with said stem in said cable unwinding direction.

11. Locking and adjustment device according to claim 7, wherein said spool has rigidly associated therewith a flange defining a seat having a helical configuration, wherein said box-like body has formed thereon a radial guide overlying said seat, and wherein said device further comprises at least one pawl element, said pawl element being partially accommodated in said seat and partially accommodated in said radial guide for defining winding and unwinding stroke limits of said spool.

12. Locking and adjustment device particularly for ski boots comprising:

a box-like body, at least one cable, at least one spool rotatably accommodated in said box-like body, means for at least partially accommodating said at least one cable on said spool, at least one pivot connected to said spool, at least one stem connected to said pivot, at least one engageable member rigidly associated with said stem, ratchet gear mounted on said box-like body and being moveable from a first position whereat said ratchet means interfere with said engageable member to permit rotation of said spool in a cable winding direction, to a second position whereat said ratchet means do not interfere with said engageable member to permit rotation of said spool in a cable unwinding direction, at least one actuating member rotatably connected to said stem externally of said box-like body, means for rotatively engaging said actuating member with said stem, at least one actuation formation rigidly associated with said actuating member, and means for converting said rotational movement of said actuating member into translatory movement of said actuation formation for moving said actuation formation into engagement with and away from said ratchet gear means for moving said ratchet gear means between said first position and said second position, wherein said means for converting said rotational movement of said actuating member into translatory movement of said actuation formation comprise:

external threads formed on said stem, and at least one threaded through seat formed in said actuating member, said threaded through seat engaging said external threads formed on said stem.

13. Locking and adjustment device acording to claim 12, wherein said means for converting said rotational movement of said actuating member into translatory movement of said actuation formation comprise;

external threads formed on said stem, and at least one threaded through seat formed in said actuating member, said threaded through seat engaging said external threads formed on said stem, and wherein said means for rotatively engaging said actuating member with said stem comprise;

at least one element rigidly associated with said pivot, and at least one face defined by said engageable element, said external threads being formed on said stem between said face and said element, said threaded through seat of said actuating member being rotatable on said external threads of said stem in one direction until said actuating member abuts said element, thereby rotatively engaging said actuating member with said stem in said cable winding direction, said threaded through seat of said actuating member also being rotatable on said external threads of said stem in another direction until said actuating member abuts said face, thereby rotatively engaging said actuating member with said stem in said cable unwinding direction.

14. Locking and adjustment device according to claim 13, wherein said actuation formation engages and moves said ratchet gear means from said first position to said second position upon said actuating member being rotated on said external threads of said stem in said another direction until said actuating member abuts said face, thereby rotatively engaging said actuating member with said stem in said cable unwinding direction.

15. Locking and adjustment device according to claim 12, wherein said spool has rigidly associated therewith a flange defining a seat having a helical configuration, wherein said box-like body has formed thereon a radial guide overlying said seat, and wherein said device further comprises at least one pawl element, said pawl element being partially accommodated in said seat and partially accommodated in said radial guide for defining winding and unwinding stroke limits of said spool.

* * * * *